US008834162B2

(12) United States Patent
Warn

(10) Patent No.: US 8,834,162 B2
(45) Date of Patent: Sep. 16, 2014

(54) TRAINING EDGED WEAPON

(76) Inventor: Spencer P. Warn, Munakata (JP)

( * ) Notice: Subject to any disclaimer, the term of this patent is extended or adjusted under 35 U.S.C. 154(b) by 0 days.

(21) Appl. No.: 13/559,793

(22) Filed: Jul. 27, 2012

(65) Prior Publication Data

US 2013/0029295 A1 Jan. 31, 2013

Related U.S. Application Data

(60) Provisional application No. 61/574,038, filed on Jul. 27, 2011.

(51) Int. Cl.

| | |
|---|---|
| ***A63H 33/30*** | (2006.01) |
| ***A63B 69/04*** | (2006.01) |
| ***A63B 71/06*** | (2006.01) |

(52) U.S. Cl.
USPC ..... 434/11; 446/473; 401/207; 273/57.3

(58) Field of Classification Search
USPC ..... 434/11, 42, 273; 446/473
See application file for complete search history.

(56) References Cited

U.S. PATENT DOCUMENTS

| | | | | | |
|---|---|---|---|---|---|
| 2,002,598 | A * | 5/1935 | Wood, Jr. | ..... | 401/207 |
| 3,481,677 | A * | 12/1969 | Abrahamson | ..... | 401/198 |
| 5,120,261 | A * | 6/1992 | Dietzman | ..... | 446/473 |
| 5,174,756 | A * | 12/1992 | Taylor | ..... | 434/11 |
| 5,181,875 | A * | 1/1993 | Hasegawa | ..... | 446/15 |
| 5,288,274 | A * | 2/1994 | Bell et al. | ..... | 472/52 |
| 5,894,959 | A * | 4/1999 | Sigurlidason | ..... | 222/192 |
| 6,299,377 | B1 * | 10/2001 | Emerit et al. | ..... | 401/266 |
| 6,352,465 | B1 * | 3/2002 | Heymann et al. | ..... | 446/473 |
| 6,497,619 | B2 * | 12/2002 | Dowdy et al. | ..... | 463/47.2 |
| 7,353,984 | B2 | 4/2008 | Quail | | |
| 7,833,130 | B1 * | 11/2010 | Horvath | ..... | 482/12 |
| 2004/0198173 | A1 * | 10/2004 | Shulman et al. | ..... | 446/473 |
| 2005/0144790 | A1 * | 7/2005 | Stanley | ..... | 30/350 |

* cited by examiner

*Primary Examiner* — Nathan Hillery
*Assistant Examiner* — James Hull
(74) *Attorney, Agent, or Firm* — Warn Partners, P.C.

(57) ABSTRACT

An edged weapon training device. The device has a handle portion for gripping by a training subject. A blade portion has at least one exposed contact portion. The contact portion includes a marking device which leaves a mark when it touches an opponent during martial arts or other edged weapon training activities.

5 Claims, 2 Drawing Sheets

TRAINING EDGED WEAPON

CROSS-REFERENCE TO RELATED APPLICATIONS

This application claims the benefit of U.S. Provisional Application No. 61/574,038, filed Jul. 27, 2011.

TECHNICAL FIELD

The present invention relates to and edged weapon training device.

BACKGROUND OF THE INVENTION

During edged weapon and martial arts training simulation weapons are often utilized. Rubber guns and rubber knives are used to train disarming and attack techniques. In order to perfect training and for sparing purposes in edged weapon training so called "dummy" knives are used for practice. While this training is valuable, often times it is hard to determine whether the stabbing and slashing of the knife is effectively engaging its target.

Therefore, there remains a need for a training edged weapon that leaves an indication of its contact with an opponent for training and evaluation of edged weapons training exercises.

SUMMARY OF THE INVENTION

An edged weapon training device. The device includes a handle portion for gripping by a training subject. A blade portion is provided which includes at least one exposed contact portion. The contact portion includes a marking device, such as inked felt, which leaves a mark when it touches an opponent during martial arts or other edged weapon training activities.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
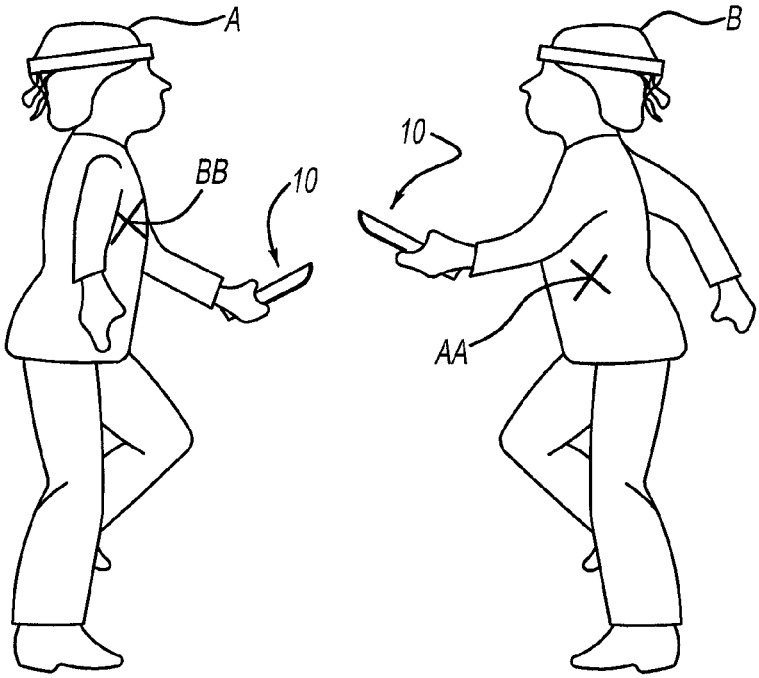
FIG. 1 is an illustrative view of the training edged weapon of the present invention, being utilized by trainees for training purposes.
Figure 2:
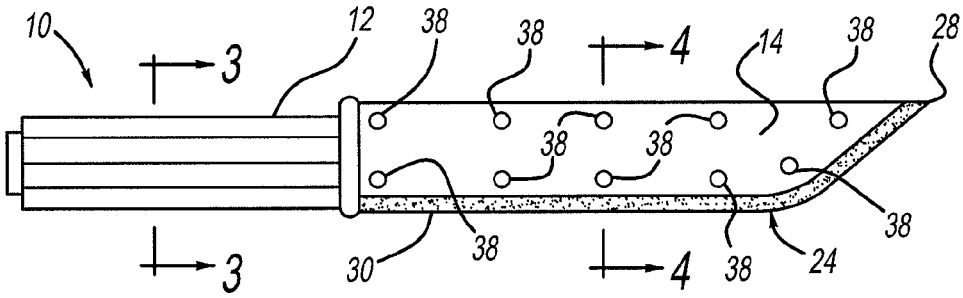
FIG. 2 is a side view of the training edged weapon of the present invention.
Figure 3:
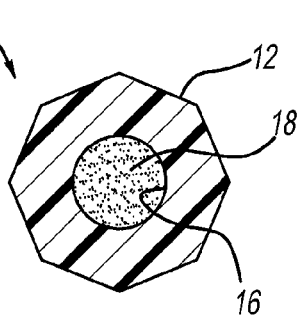
FIG. 3 is a sectional view of the handle of the training edged weapon of the present invention taken along line 3-3 of FIG. 2.
Figure 4:
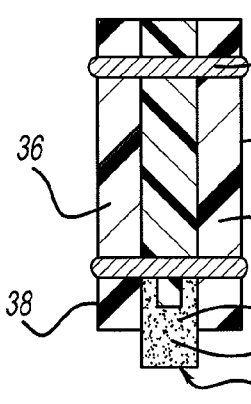
FIG. 4 is a sectional view taken along line 4-4 of FIG. 2.
Figure 5:
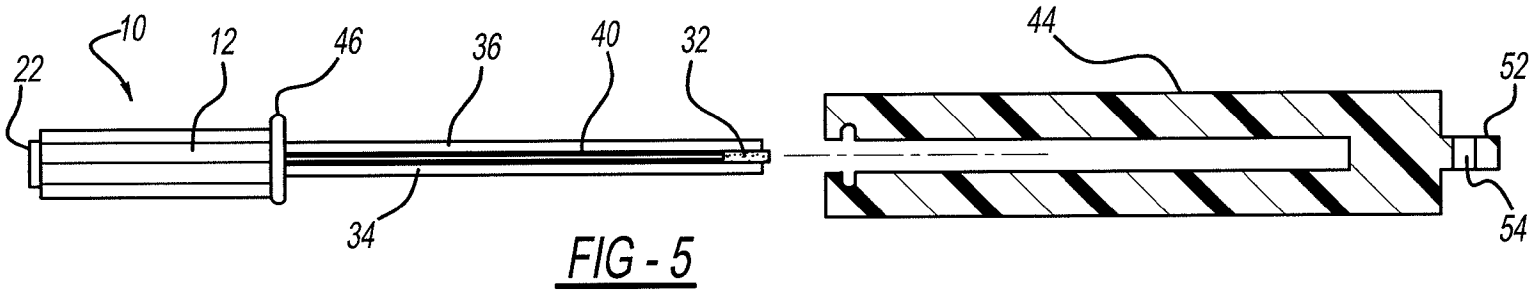
FIG. 5 is a top view of the training edged weapon of the present invention and a sectional view showing details of the air tight sheath or blade over.
Figure 6:
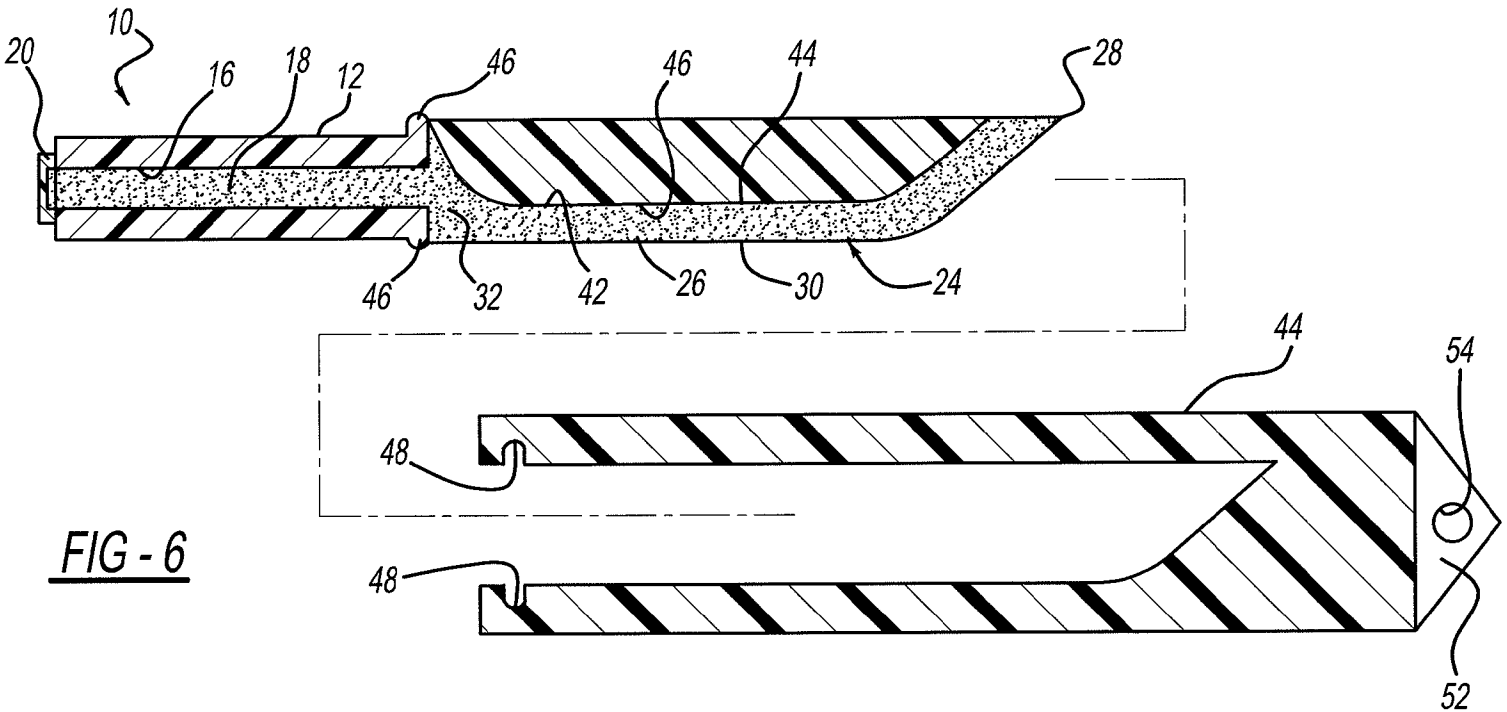
FIG. 6 is a sectional view of the training edged weapon and sheath.

In accordance with the present invention, there is provided an edged weapon training device 10 that marks targets or opponents (A) and (B) which it contacts and leaves associated marks BB and AA on the subjects during edged weapon training exercises.

The device 10 includes a handle portion 12 operatively attached to a flexible blade portion 14. The handle portion 12 is shaped such that it is a suitable grip for gripping by a trainee (A or B). Handle 12 includes a cavity 16 in which ink 18 or another marking substance is stored. While the handle can be in any suitable shape to provide a proper grip and the like, a preferred shape is an octagonal cross section. Handle 12 is also preferably made of a compressible material such as a polymer or elastomer which may be compressed by the users grip in order to force ink 18 to the flexible blade portion 14. The cavity 16 is re-fillable through a channel portion 20 over which a threaded cap 22 or the like is used to seal the channel from leakage during use.

The blade portion 14 includes at least one exposed contact portion 24 said contact portion 24 includes a marking device 26 which leaves a mark (AA or BB) when it touches an opponent (A or B) during martial arts or other edged weapon training activities. The contact portion 24 is designed to be the point 28 and or edge 30 of the blade to simulate a real knife in training. The marking device 26 is a thin edged material made of ink holding substance such as felt that is exposed at the point 28 and or edge 30 of the blade. The ink holding substance is selected such that it will release a mark on the opponent when contacting an opponent. A felt type material which is either natural or synthetic is preferred, however, other types of material which will function to hold ink or other marking substance from the reservoir and allow release upon contact is used in the present invention.

In a preferred embodiment, a felt insert member 32 is in communication with the cavity 16 of the blade portion 14. The felt member 32 is sandwiched between two layers 34, 36 (first and second side members) of the blade portion 14 such that the edge 30 and the point 28 of the blade portion 14 include exposed felt portions. The two layers 34, 36 of the blade are secured together and hold the felt in place via a series of fasteners 38. The fasteners 38 may be rivets, bolts or even heat staked or welded in place. In a preferred embodiment, a spine portion 40 is included for providing flexible rigidity in the blade and reducing the amount of felt or other material. In this embodiment, the spine is interposed between the first and second sides 34, 36 and has a profile which is recessed in the blade with the first and second sides forming the edge profile of the blade. The felt member 32 has a recess 42 in a back side 44 for the felt member 32. The recess 42 follows the recessed contour 46 of the spine member. The sides may be made of aluminum which is flexible and has non-cutting edges. In a preferred embodiment, the sides and spine are made of a flexible polymer or elastomeric material such that it will flex during contact to avoid injury to an opponent.

A sheath member 44 is provided for securing around the knife to keep the ink in the felt from drying out. The handle includes a locking and sealing protrusion 46 around its outer periphery. The sheath includes a nesting groove 48 in its inner wall cavity 50 and is made of a resilient flexible material such as a rubber, polymer or elastomer which expands over the protrusions and seals to the handle for a substantially airtight seal to ensure that the ink remains fluid. A lanyard receiving portion 52 with an opening 54 is provided such that a lanyard may be attached. The edged training weapon may be stored for use around a trainee's neck or maybe stored on a hook or the like in the training facility.

In operation, the knife is wielded like a normal knife and leaves marks at contact points during sparring and the like such that evaluation of the knife strikes is apparent. The handle of the knife may be squeezed for providing marking fluid to the blade and or point area. The storage cavity is refilled with marking fluid by way of removal of the cap and refilling the cavity.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An edged weapon training device comprising a handle portion for gripping by a training subject; and a blade portion, wherein said blade portion includes a first side having a cavity forming portion connected to a second side having a corresponding cavity forming portion, and including a marking device being retained between said first side and said second side, said marking device retaining an ink or other marking fluid, wherein said sides are attached to a structural spine, and said sides forming a blade shape of the entire shape of the blade, and said marking device forming only the exposed edge shape of the blade, wherein the marking device has an inner contour which conforms to the shape of the spine, and the first side and the second side sandwich the spine and the substance there-between, said sides, spine, and marking device are riveted in place using rivets, and said rivets are heat staked to attach the sandwich layers, wherein said sides and spine are formed of a flexible elastomeric material, wherein said marking device comprises a felt-like material configured to hold ink or other marking substance and allow release upon contact, wherein said marking device forms a contact portion at the edge of the blade meant to simulate an edge of a real weapon for marking an opponent in an edged training exercise, wherein said handle includes a reservoir in communication with said marking device such that an ink or other marking substance can be replenished to the marking device contact portion, wherein said reservoir may be compressed by hand pressure for delivering said ink or other marking substance to said contact portion of the marking device forming the edged portion of the blade; and a sheath for encompassing said blade portion with a substantially air tight seal for preserving the marking substance between uses, said handle including a locking and sealing protrusion around its outer periphery and said sheath includes a nesting groove, said sheath being made of a resilient flexible material which expands over the protrusion and seals to the handle for providing a substantially air tight seal to ensure the transferable marking substance remains fluid.

2. The edged weapon training device in accordance with claim 1, wherein the sides and spine are formed of aluminum.

3. An edged weapon training device comprising:

an octagonal elastomeric handle portion for gripping by a training subject including a reservoir therein; and a blade portion, said blade portion including a first side having a cavity forming portion connected to a second side having a corresponding cavity forming portion, and including a marking device being retained between said first side and said second side and forming a contact portion, said marking device retaining an ink or other marking fluid, said marking device being a felt like material in communication with the reservoir in the handle, wherein said sides are attached to a structural spine and said sides forming a blade shape of the entire shape of the blade and said marking device forming only the exposed edge shape of the blade, wherein the marking device has an inner contour which conforms to the shape of the spine, and the first side and the second side sandwich the spine and the substance there-between and are riveted in place using rivets, said rivets are heat staked to attach the sandwich layers, wherein said sides and spine are formed of a flexible elastomeric material, wherein said marking device forms a contact portion at the edge of the blade meant to simulate an edge of a real weapon for marking an opponent in an edged training exercise, wherein said reservoir is in communication with said marking device such that an ink or other marking substance can be replenished to the marking device contact portion, wherein said reservoir may be compressed by hand pressure for delivering said ink or other marking substance to said contact portion of the marking device forming the edged portion of the blade; and a sheath for encompassing said blade portion with substantially air tight seal for preserving the marking substance between uses, one of said handle or said sheath including a locking and sealing protrusion around its outer periphery and the other of said handled or sheath includes a nesting groove, said sheath being made of a resilient flexible material which expands over the protrusion and seals to the handle for providing a substantially air tight seal to ensure the transferable marking substance remains fluid.

4. The edged weapon training device of claim 2 wherein the first side, second side and spline are an aluminum material.

5. The edged weapon training device of claim 3 wherein said first side, second side and spline are a polymer material.

* * * * *